US005755270A

United States Patent [19]

Knezevich et al.

[11] Patent Number: 5,755,270

[45] Date of Patent: May 26, 1998

[54] ACCORDION SHUTTER SYSTEM

[76] Inventors: Vladimir John Knezevich, 1225 NE. 95th St., Miami, Fla. 33138; John William Knezevich, 2701 W. Oakland Park Blvd., Suite 240, Miami, Fla. 33311; Frank S. Cornelius, 5795 NW. 36th Ave., Miami, Fla. 33142

[21] Appl. No.: 744,202

[22] Filed: Nov. 5, 1996

[51] Int. Cl.[6] ..... E05D 15/26

[52] U.S. Cl. ..... 160/183; 160/118

[58] Field of Search ..... 160/183, 199, 160/118, 206, 201, 235, 236, 233, 196.1, 229.1, 113, 114, 119

[56] References Cited

U.S. PATENT DOCUMENTS

| | | | |
|---|---|---|---|
| 4,386,645 | 6/1983 | Dever et al. | 160/183 |
| 5,097,883 | 3/1992 | Robinson et al. . | |
| 5,099,904 | 3/1992 | Susnar | 160/183 X |
| 5,458,179 | 10/1995 | Magaldi et al. . | |
| 5,472,037 | 12/1995 | Hoffman | 160/183 |
| 5,477,646 | 12/1995 | Dietz et al. . | |
| 5,477,903 | 12/1995 | Figueiredo et al. . | |
| 5,487,243 | 1/1996 | Hale et al. . | |
| 5,487,244 | 1/1996 | Hill . | |
| 5,509,239 | 4/1996 | Fullwood . | |
| 5,522,190 | 6/1996 | Fullwood . | |
| 5,522,445 | 6/1996 | Hoffman | 160/183 |
| 5,524,403 | 6/1996 | Fullwood . | |
| 5,533,308 | 7/1996 | Fullwood . | |
| 5,537,779 | 7/1996 | Jackson . | |
| 5,549,148 | 8/1996 | Figueiredo et al. | 160/183 |
| 5,566,739 | 10/1996 | Hoffman | 160/183 |
| 5,601,130 | 2/1997 | Werner et al. | 160/183 |

*Primary Examiner*—David M. Purol

*Attorney, Agent, or Firm*—Lott & Friedland, PA

[57] ABSTRACT

This invention relates to a strong, light weight accordion shutter system that increases strength while decreasing weight, and is especially resistant to hurricane force winds and flying objects when used to cover doors, windows or openings. More specifically, this invention relates to a shutter system comprising a plurality of connectable subsystems of shutters that are connected via a shutter mating system which provides sufficient strength to obviate the need to drill locking holes during installation and connection. This accordion shutter system also offers a unique ability to secure doors, windows and openings of any size from forced entry and enables the user to operate from either side of the shutter system.

14 Claims, 9 Drawing Sheets

ACCORDION SHUTTER SYSTEM

TECHNICAL FIELD

This invention relates to a strong, light weight accordion shutter system that increases strength while decreasing weight, and is especially resistant to hurricane force winds and flying objects when used to cover doors, windows or openings. More specifically, this invention relates to a shutter system comprising a plurality of connectable subsystems of shutters that are connected via a shutter mating system which provides sufficient strength to obviate the need to drill locking holes during installation and connection. This accordion shutter system also offers a unique ability to secure doors, windows and openings of any size from forced entry and enables operation from either side of the shutter system.

BACKGROUND OF THE INVENTION

In coastal and non-coastal areas subjected to high winds and flying objects from wind and rain storms, tornadoes, hurricanes or typhoons, accordion shutters traditionally have been used that lacked the strength to resist flying objects like a 9 pound 2×4 traveling at 34 M.P.H. while resisting hurricane force winds in excess of 155 M.P.H. on an 8 feet tall shutter, installed on a one story residence. Some accordion shutters are much larger in blade width, and component thickness, while actually being weaker. Others are very heavy and bulky causing considerable difficulty in operation, have large protrusions from the wall when stacked and difficulty walking over the wide bottom track when used across doorways and are extremely expensive and unattractive. Further, as a plurality of separate systems must be connected when covering larger areas due to installation and transportation difficulties of large single systems, prior accordion systems required that locking pins be custom drilled to provide for adequate strength in the connecting areas. Also, accordion shutters have historically required two or three guide pins per blade, with one or two rows of these guide pins following the outside of a top and bottom guide track while another rides in a groove.

There has been a need for accordion shutters built for wide openings to be manufactured in sections that can be assembled in the field. Further, when leaving the accordion shutters in an open position, there has heretofore been no convenient method of securing the contracted shutters in the open position. By providing a securing clip an effortless securing means has been provided for. This invention addresses the shortcomings of previous accordion shutters by providing resistance to high winds and protection from a 9 pound 2×4 traveling at 34 M.P.H. Further, it has a very low weight per square foot of deployed shutter system and is easy to operate. It has minimal protrusion from the wall when stacked at edges of the opening and the system provides for ease of maintenance for the guide pins, trolley and blade replacement and the capability of the accordion shutter to be assembled from factory assembled smaller sections, in the field, by the unique gate locking system hereinafter described. This facilitates the installation of very wide shutters without undue weight problems for the installer.

SUMMARY OF THE INVENTION

The shutter system of the present invention provides a unique accordion shutter system wherein a plurality of subsystems can be combined via a unique shutter mating system. The system comprises a top, single mounting flange guide pin track and a bottom mounted guide pin track. Hinged vertical blades, are supported therebetween at every other knuckle by a top dual wheeled trolley with guide pin and screw assembly. For attaching separated segments of blades is included a very unique connecting or shutter mating system which enables the accordion shutter system to be assembled with greater ease, while decreasing the weight of the system significantly and still conforming with the 1994 South Florida Building Code and the 1994 Standard Building Code. It is an object of this invention to provide an easy to install, strong accordion system that can protect nearly any size opening by providing a shutter mating system which connects a plurality of subsystems. It is another object of this invention to enable each subsystem to be locked in the open position.

These and other objects, features, and advantages of the present invention may be more clearly understood and appreciated from a review of the following detailed description of the disclosed embodiments and by reference to the appended drawings and claims.

BRIEF DESCRIPTION OF THE DRAWING FIGURES

DETAILED DESCRIPTION OF THE PREFERRED EMBODIMENT

Figure 1:
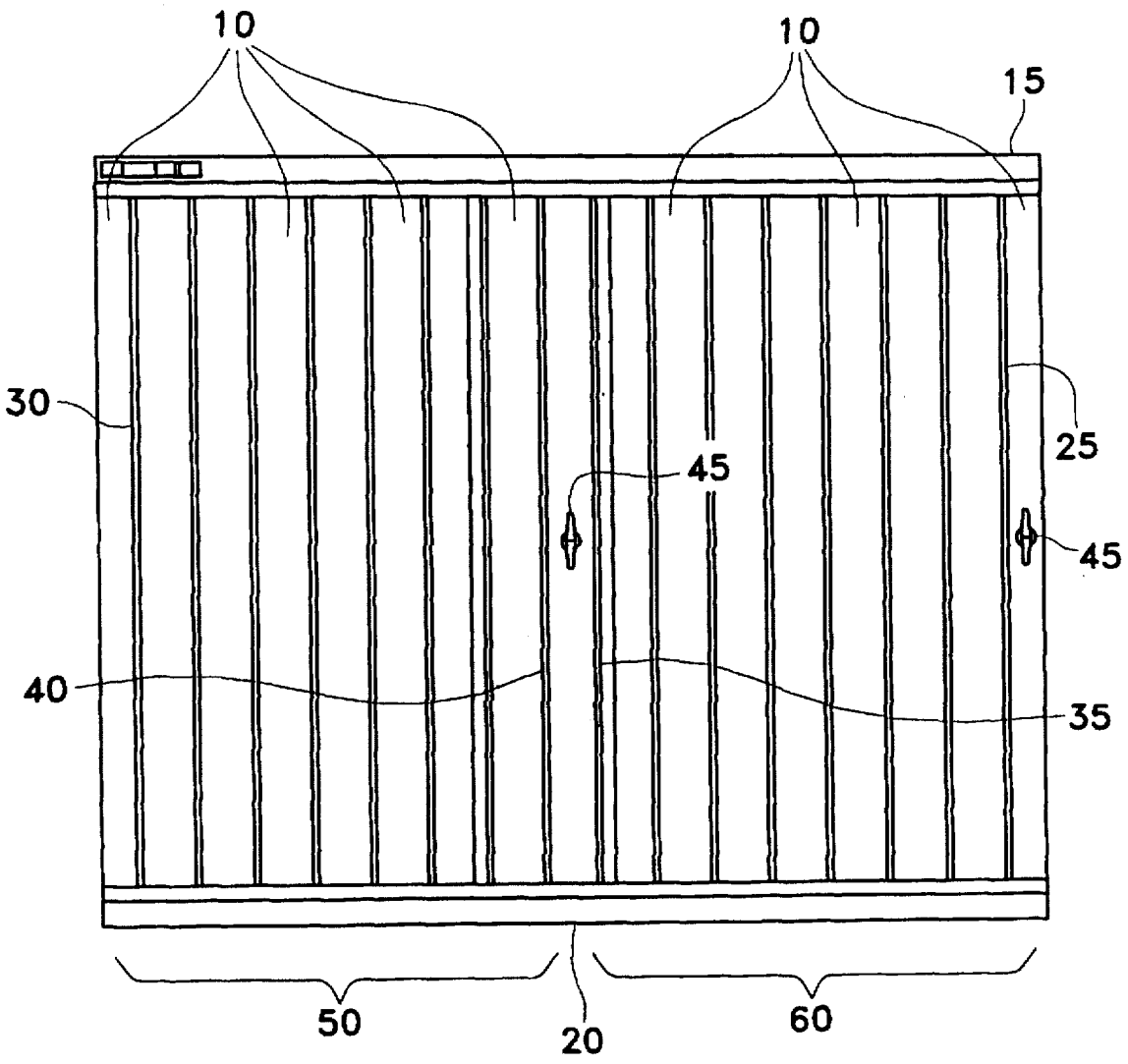
FIG. 1 is an elevation of the deployed accordion shutter system, with the unique shutter mating system shown in the middle and as an option, at the far end. Additionally, an open position holding clip is depicted.

The accordion shutter system of the present invention is made up of a top built out guide pin track that mounts to a wall surface with fasteners and a bottom, single flange built out guide pin track mounted to a wall surface. The top and bottom guide pin tracks alternatively can be attached directly to a ceiling or floor. It is understood that any combination of header and sills is possible. The hinged vertical blade, is supported at every other knuckle by a top dual wheeled trolley with a guide pin and screw assembly. A guide pin and screw are used in the remainder of the top blade knuckles that align with the top guide track. A bottom guide pin and screw is installed in each knuckle that aligns with the groove in the bottom track.

The knuckles that do not align with the groove in the track can receive optional screws and washers to secure the connection of the male and female edges of the blade, but do not receive guides. These trolleys and guides follow their respective top and bottom guide tracks for operation. The blade is substantially rectangular in appearance and when viewed as an elevated cross section, the blade has female and male ends. The female end comprises an integrally formed greater than 180° degrees hollow, partial cylinder which forms the outside of the hinge or knuckle. The outside of this knuckle is smooth while the inside has two internal hooks or stops protruding inward from the inside surface of the female partial cylinder.

The male end is a smaller in diameter partial cylinder with one outward protruding hook or stop that fits inside one female section. A second hook or stop protrudes from an offset connection arm integrally connected to the blade. The placement of this protrusion on the arm as opposed to the outer circle allows for greater shear strength. The male end is also the end of the blade that receives the dual trolley wheels or guide pin. The male end of the blade is especially shaped to allow for an external interlock at the knuckle. The use of both locking mechanisms limits the blade opening to approximately 100° degrees.

The shutter members, when deployed, are arranged in a continuous v pattern (sinusoidal in appearance), which follows the header and sill grooves. The edge portions of adjacent shutter members are connected so as to allow each blade to rotate with respect to the adjacent blades.

In order to provide for ease of installation, manufacture and transport of the shutter system, the system comprises a plurality of sub-systems which are combined using the shutter mating system of the present invention. These subsystems may be connected to a wall, column, structural stop and then to each other. The present invention utilizes a unique connecting means for attaching a plurality of sections of accordion storm shutters described in detail herein. Mechanical locks may be added to the shutter mating systems to provide for security. These locks utilize a hook and stop system to maintain strength.

On each end of the shutter subsystems are starter strips FIG. 16, 1605 and 1620, FIG. 6, 600 and FIG. 7, 700 that allow the shutter to be attached to a wall, column or mullion. This starter strip has a 180° degree FIG. 6 or a 90° degree FIG. 7 flat mounting surface on one side, while offering the same female cylindrical section as found on the blades on the other side. This facilitates the attachment of the blade to a wall, column or mullion.

Figure 3:
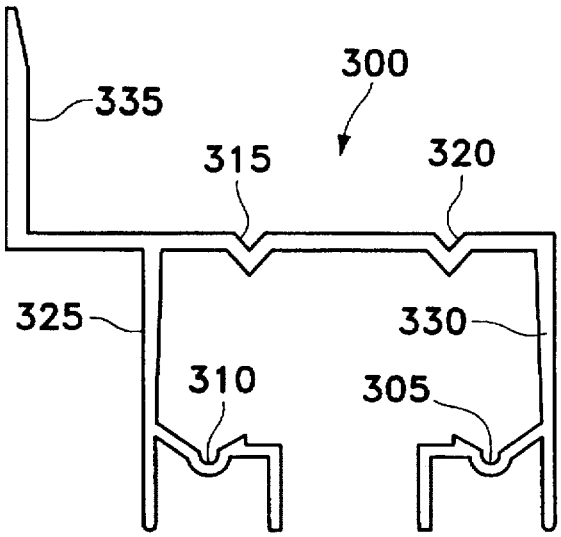
FIG. 3 is a cross sectional view of an extruded, wall mounted, built out header for the shutter system.

Wall mounted headers FIG. 3 are rectangular sections with a flange at one top end and parallel continuous grooves and a continuous notch in the center of the bottom that receives the wheels of the trolley assembly and a guide pin. The wall mounted headers that receive the pin/trolley/blade assembly are designed to be mounted from this single flange on top of the wall header.

Figure 2:
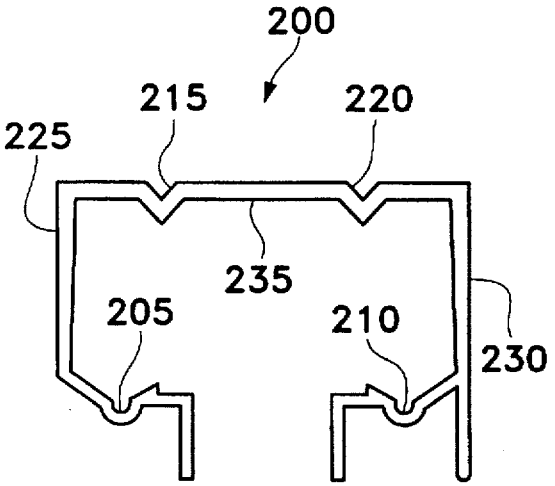
FIG. 2 is a cross sectional view of an extruded, trap mounted header for the shutter system.

Ceiling mounted headers, FIG. 2, are a substantially rectangular section with a continuous notch in the center of the bottom that receives the wheels of the trolley assembly and a guide pin. The ceiling mounted headers, FIG. 2, that receive the pin/trolley/blade assembly are designed to be mounted from the top. The headers may include receivers (not shown) for felt strips on either side of the notch that receives the pin or trolley assembly. These strips allow easier and quieter operations.

Figure 4:
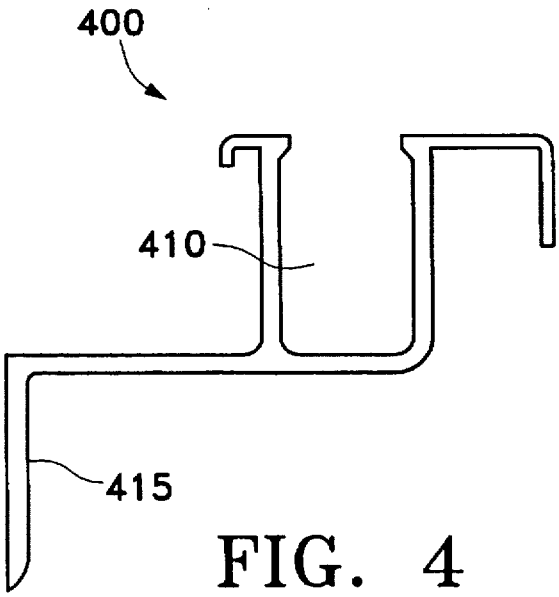
FIG. 4 is a cross sectional view of an extruded, wall mounted built out sill for the shutter system.
Figure 6:
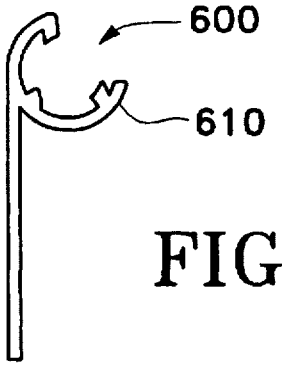
FIG. 6 is a cross section view of an extruded, wall mounted, 180° degree starter strip.

The wall mounted sill of FIG. 4 is basically an angular cross section with notch or groove configuration setting on top of the angle to receive the guide pin assemblies. The wall mounted sill can be mounted from a singular flange positioned below the shutter for ease of access. This flange can be wall mounted in the desired vertical location to effect the proper blade clearances for optimum performance and operation.

Figure 5:
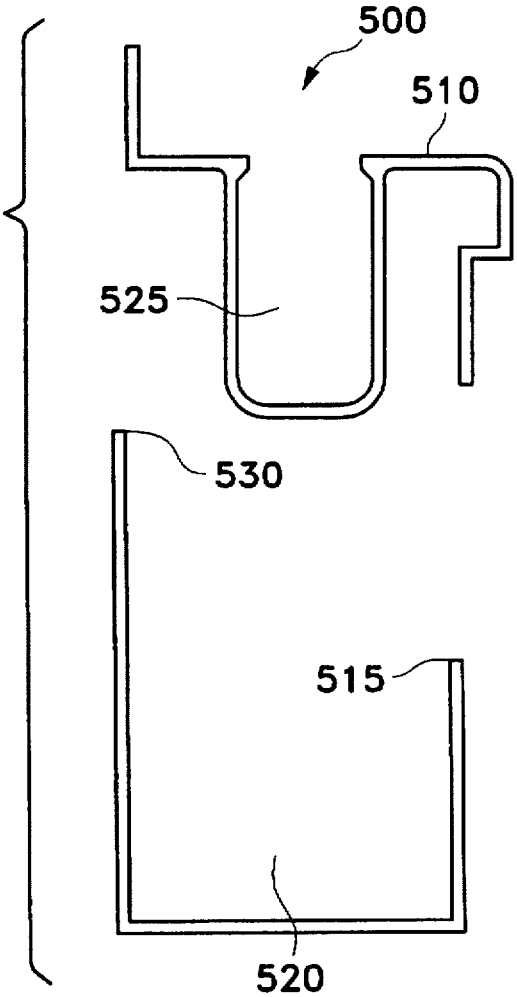
FIG. 5 is a cross sectional view of an extruded, trapped mount or wall mount two piece adjustable sill which is used when varying the distance between the header and sill is required.

The adjustable sill of FIG. 5, is a two piece receiver for the guide pin assemblies. Each piece is shaped in a channel configuration. The top piece 500 has a notch or groove formed into the wide part of the horizontal part of the channel section and this top piece fits into the bottom piece 520 with overlapping vertical sections 515 and 530 that allow the top section to be raised as needed to achieve the proper blade to sill clearances for optimum shutter performance and operation. When proper clearances are determined and the part adjusted, screws or rivets may be used to secure the relative positions of the two components of this adjustable sill. The adjusted and fastened adjustable sill assembly now has a rectangular appearance with the long flat bottom section anchored to the floor directly or it can utilize an equal angle at the back for optional track anchorage or for a removable track capability (See FIG. 14).

A frontal view of the accordion shutter system which embodies this inventions is shown in FIG. 1. The accordion shutter system is made up of a plurality of interlocking blades 10 and shutter subsystems 50, 60 riding in and guided by an elongated header 15 and an elongated adjustable sill assembly 20. It is appreciated that although two connected subsystems are depicted in FIG. 1, there is no limit as to the number of subsystems that can be connected utilizing the shutter mating system of the present invention and the number used is based entirely on the size of each subsystem and the area desired to be covered. The system includes an optional, 90° degree starter strip 25 at one side and an optional, 180° degree starter strip 30 on the other side. The shutter system is held together by a unique shutter mating system comprising a male mate 35 and a female elongated and interlocking mate 40 held together by a mechanical lock 45, more clearly illustrated infra.

Figure 14:
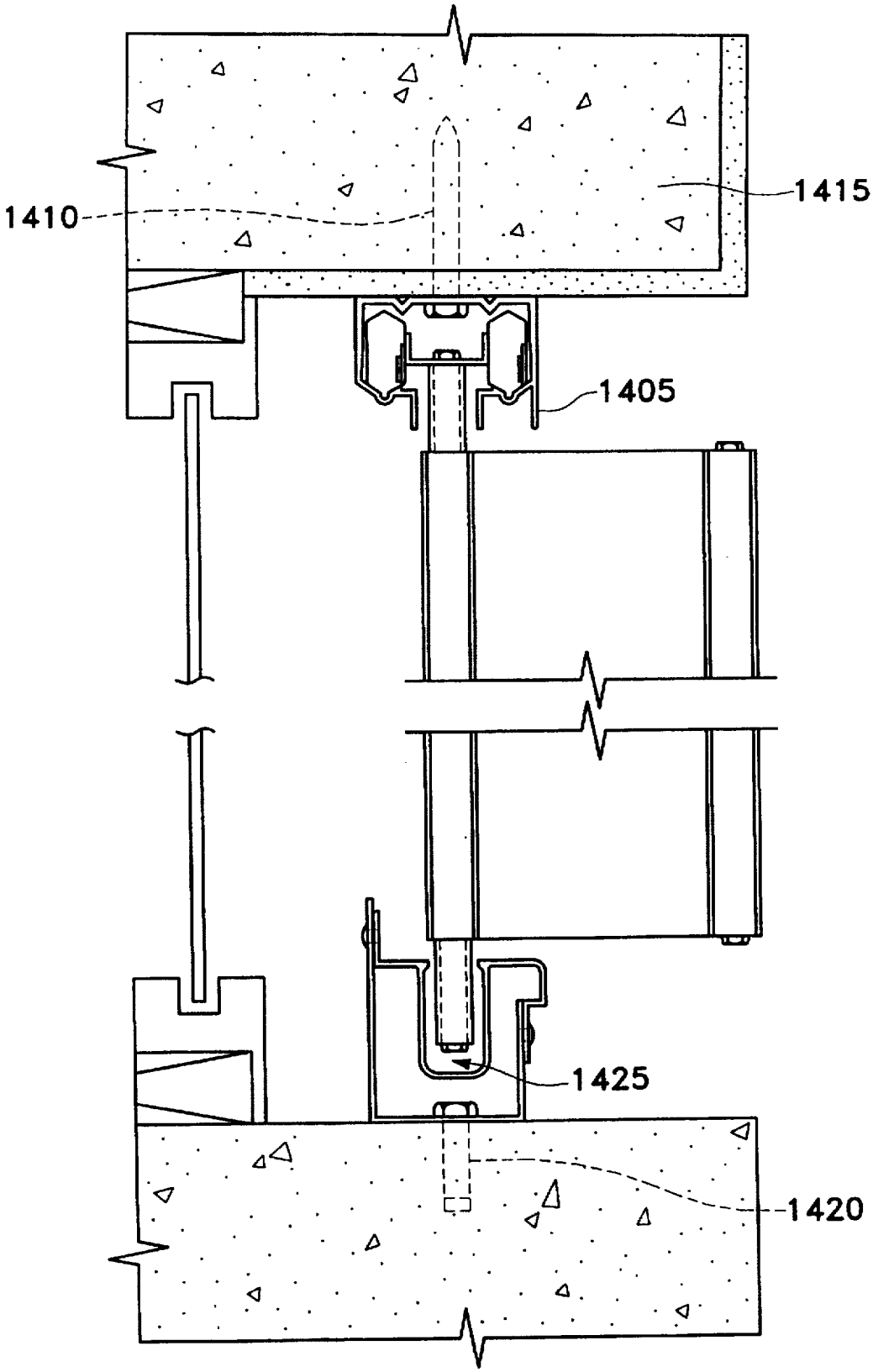
FIG. 14 is a profile cross section of the accordion shutter system of the present invention.

FIG. 2 is a cross section view of the continuously extruded header 200 used in a trapped mounting condition as shown in FIG. 14, 1405. The trolley wheel seats 205 and 210 are symmetrical about the vertical centerline of header 200. The "V" shaped protrusions 215 and 220 are also located symmetrically about the vertical centerline of header 200. These help maintain alignment of the trolley wheels when they are rolling. The sides 225 and 230 are tapered for maximum strength while minimizing weight and therefore cost. Mounting is accomplished by a fastening means such as screw 1410 being placed through the top horizontal member 235, into the horizontal surface to be attached to 1415.

FIG. 3 is a cross section view of the continuously extruded built out header 300 used in a wall mounting condition. The trolley wheel seats 305 and 310 are symmetrical about the vertical centerline of header 300. The "V" shaped protrusions 315 and 320 are also located symmetrically about the vertical centerline of the top portion of header 300. These help maintain alignment of the trolley wheels when they are rolling. The sides 325 and 330 are tapered for maximum strength while minimizing weight and therefore cost. Mounting is accomplished by a fastening means such as screws being placed through the vertical connecting member 335 to the vertical surface to be attached to.

FIG. 4 clearly defines a built out wall mounted sill 400. This component is a continuous extrusion and acts as a guide way for the lateral movement of the shutter array via u-shaped canal 410. This built out sill 400 has a single mounting flange 415 turned down for easy, quick and economical installations. Mounting flange 415 is attached to a vertical surface by a fastening means such as screws placed through the single mounting flange 415 to the vertical surface it is to be attached to.

FIG. 5 clearly defines the two component adjustable sill 500. This sill is made up of a continuously extruded top section 510 and a continuously extruded bottom section 515 wherein the top section 510 slides up or down in the interior 520 of bottom section 515. Interconnection is further depicted in FIG. 14, 1425, with the two sections 510 and 515 finally secured with tek screws or rivets as depicted in FIG. 14, 1420. A U-shaped canal 525 in the top section provides the guideway for the lateral movement of the shutter array, FIG. 14, 1425.

Shown generally as 600, the 180° degree starter strip component is a continuous extrusion with female hinge portion 610 at one extremity that allows the shutter array to be attached to a wall at one end and to the blade members at the other. The 180° degree starter strip is shown connected in FIG. 16, 1605 to a wall with a tek screw 1610. This configuration enables the shutter assembly to be immediately adjacent and on the interior of a connecting wall.

Figure 7:
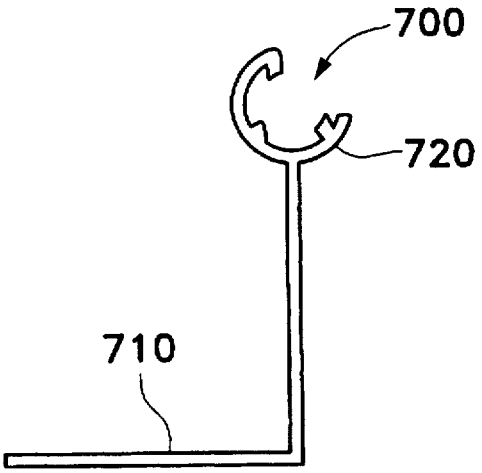
FIG. 7 is a cross sectional view of an extruded, wall mounted, 90° degree starter strip.

FIG. 7 illustrates the 90° degree starter strip 700. In contrast to the 180° degree starter strip, the 90° degree starter strip possesses an integrally attached and substantially perpendicular connecting member 710 enabling connection to the front portion of a wall with a frontal offset. Shown as 1620 of FIG. 16, the 90° degree starter strip's perpendicular member 710 is rigidly attached via a connecting means such as a masonry screw anchor 1615. The amount of frontal offset from the connecting wall is determined by strength requirements and the length of the 90° degree starter strip. As with the 180° degree starter strip, the 90° degree starter strip component is a continuous extrusion with female hinge portion 720 at one extremity that allows the shutter array to be attached to a wall with a frontal offset at one end and to the blade members at the other.

Figure 8:
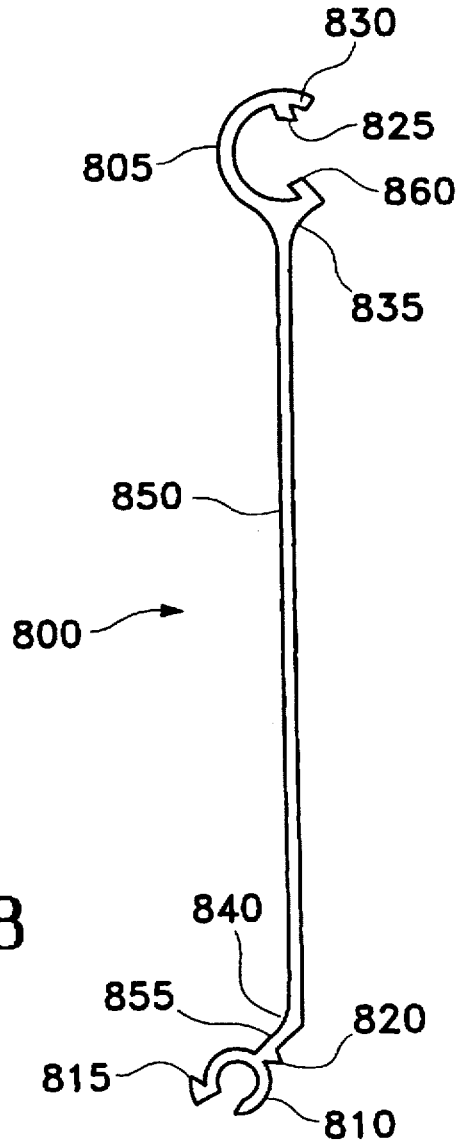
FIG. 8 is a typical cross section of an extruded blade with a male end and a female end. Each end makes up one half of the hinge mechanism.

An elevated cross section of a continuously extruded accordion shutter blade is shown generally as 800 in FIG. 8. This component has a male end 810 and a female end 805 which allows the shutter to interlock forming a hinge depicted more clearly in FIG. 15, 1510. This hinge is made up of a male section with one exterior hook 815 on the outside of the greater than 180° degree cylindrical member engaging portion 810 and one protrusion 820 integrally connected to the offset arm on the side opposite the exterior hook 815. The female section is a greater than 180° degree formed cylindrical member with one interior hook 825 offset from the end portion of the 180° degree formed cylindrical member so as to form a receiving notch 830 for engaging said male exterior notch 820. A second interior hook 860 is located at the end of the opposite side of the 180° degree formed cylindrical member of the female end forming an acute angle in relation to the interior of said circle for engaging said interior hook of said male end 815 when the hinge mechanism is in the extended position. As can be seen in FIG. 8, in order to decrease weight while maintaining sufficient strength, a unique taper and expand structure has been devised. Tests have shown that when force has been applied to the prior shutter systems, the failure point is predominantly located in the connecting joints such as in 835 and 840. By tapering the blade in non-failing areas such as in the center of the blade 850 and expanding the thickness of the blade in failing areas such as 835 and 840, significant weight saving can be accomplished without sacrificing strength.

Figure 9:
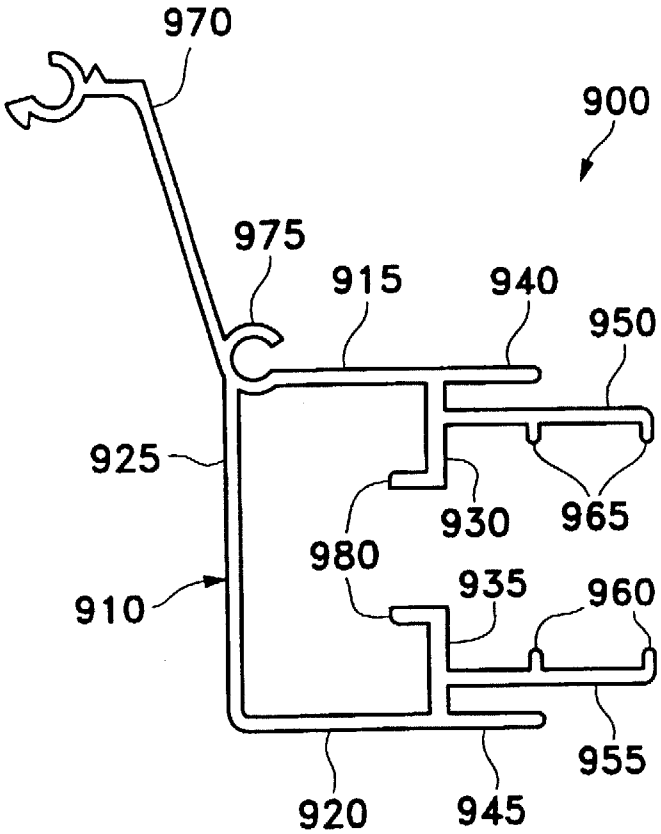
FIG. 9 depicts the female end of the two piece shutter mating system of the present invention.

The female section of the unique shutter mating system of the present invention, illustrated in FIG. 9, obviates the need for drilling locking holes and placement of locking pins, which heretofore have been required due to strength requirements. By obviating the need for locking pins, the manufacture, installation and operation of the storm shutters of the present invention is far simpler. The female section of the shutter mating system 900, depicted in the connected state in FIG. 15, 1515, and FIG. 16, 1635 provides enhanced structural support by providing a triple U-lock. The exterior U-lock 910 has an upper member 915, lower member 920 and vertical member 925 all integrally and substantially perpendicularly connected to form the U-shape of said exterior U-lock 910. The upper member of said U-lock has an integrally connected, inwardly facing substantially perpendicular L member 930 positioned sufficiently before the end of said upper member 915 so as to provide for an upper extension member 940. The lower member of said U-lock has an integrally connected, inwardly facing substantially perpendicular L member 935 also positioned sufficiently before the end of said lower member so as to provide for a lower extension member 945 wherein in combination with upper extension member 940 another U-lock is formed. L members 930 and 935 are positioned opposite each other so that the base of said L members form an inwardly facing, interior U-lock themselves 980, which will rest in clip member 1100 notch's 1115 and 1120 described in detail infra. Upper L-member 930 has an integrally connected substantially perpendicular member 950 offset from said extension member 940. A plurality of protrusions 965 are located thereon to provide for greater surface area and therefore greater support. Lower L-Member 935 has an integrally connected substantially perpendicular member 955 offset from said lower member 945. On said lower perpendicular member 955 are a plurality of protrusions 960 to provide for greater surface area and therefore greater support. Upper perpendicular member 950 and lower perpendicular member 955 together form a third U-lock in the triple U-lock structure.

Figure 17:
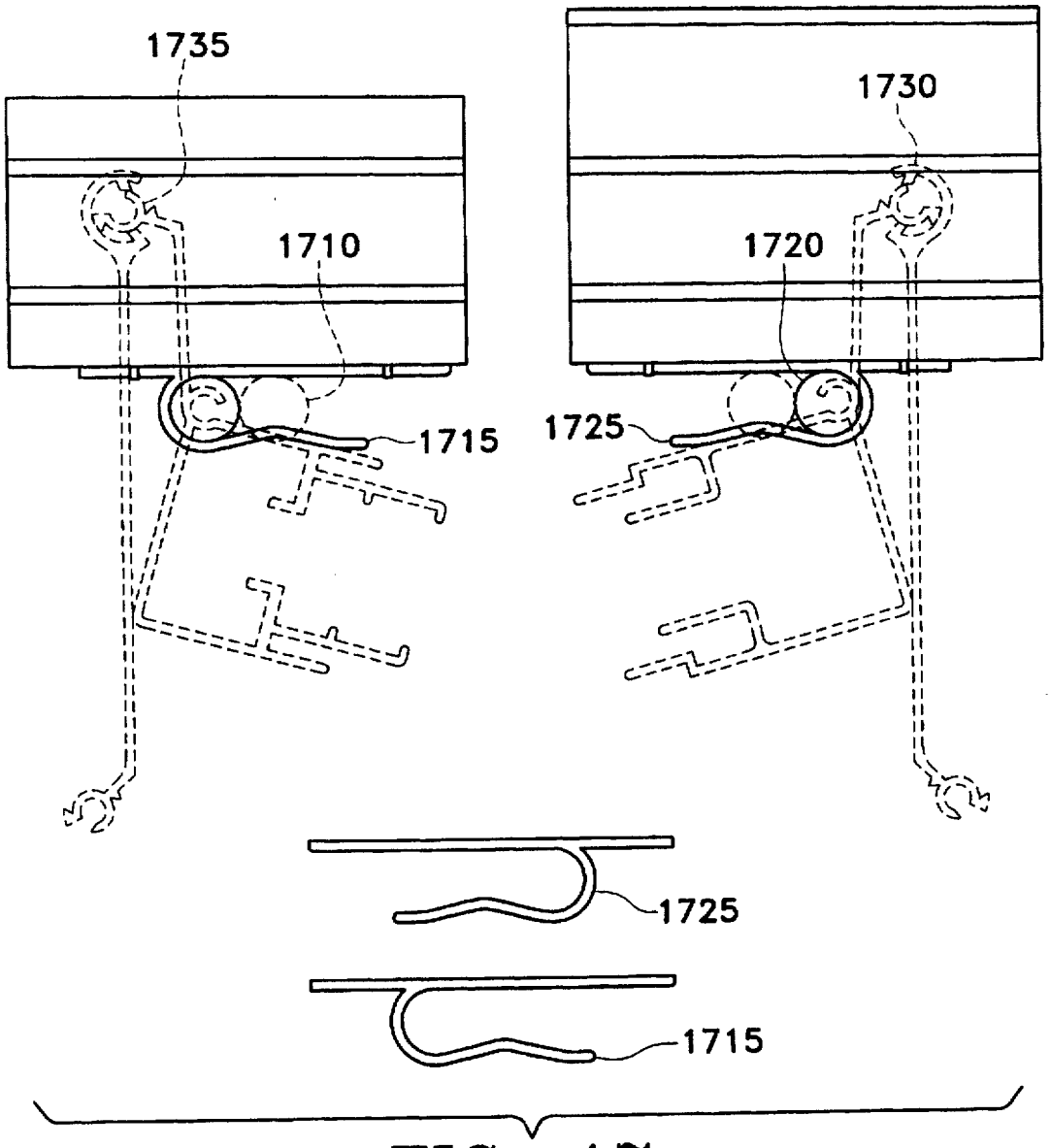
FIG. 17 depicts the accordion shutter system of the present invention in the open position with the securing posts fitting snugly into their respective retaining clips on either side of the header and sill.

To provide for connection of the U-lock mechanism with the blades of the shutter system, a male end of hinge 810 is integrally connected to said female U-lock shown as 970. Further, as another novel aspect of this shutter mating system, a shutter-open-securing device 975 is located at the corner angle formed by the male end of hinge 810 which is integrally connected to said female U-lock shown as 970 and the upper member 915 of exterior U-Lock 910. This is shown connected to a blade in FIG. 17, 1735. Said shutter-open-securing device 975 comprises a greater than 180° degree formed cylindrical member wherein is placed a screw or similar securing structure whereon a plastic spacer is placed. As clearly shown in FIG. 17, said plastic spacer 1710 is inserted into a clip member 1715 thus securing the shutter blades when in the open position.

Figure 10:
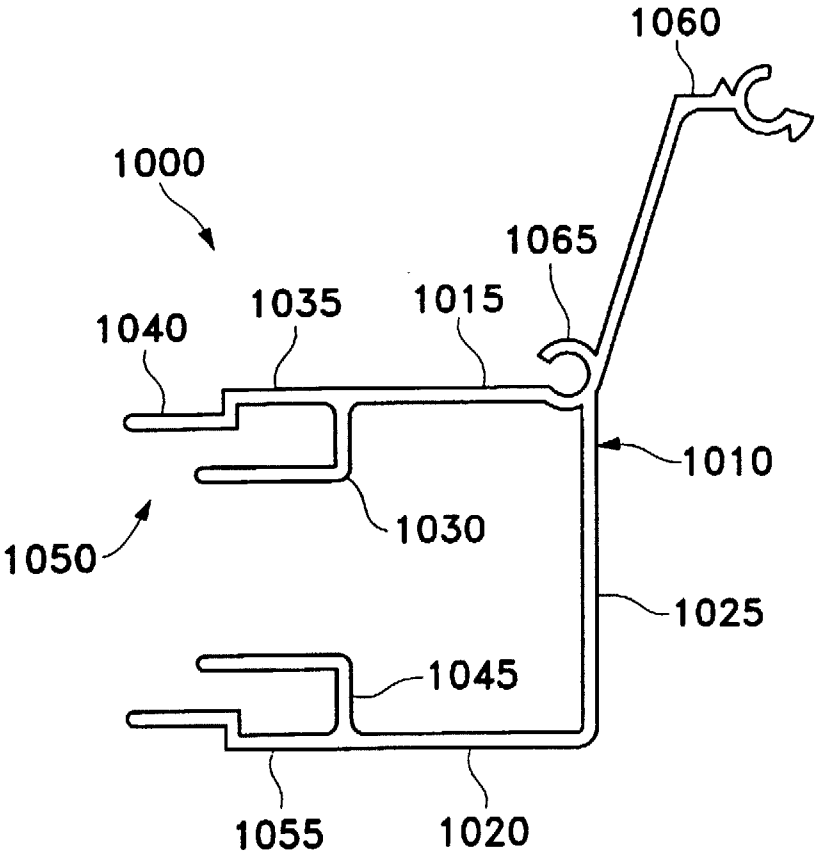
FIG. 10 depicts the male end of the two piece shutter mating system of the present invention.

The male section of the unique shutter mating system of the present invention illustrated in FIG. 10 also obviates the need for drilling locking holes and placement of locking pins, which heretofore have been required due to strength requirements. The male section of the gate locking system 1000, depicted in the connected state in FIG. 15, 1515, has an exterior U-lock 1010 which is smaller than its male counterpart so as to fit snugly into the female exterior U-lock 910 and has an upper member 1015, lower member 1020 and vertical member 1025 all integrally and substantially perpendicularly connected to form the U-shape of said smaller exterior U-lock 1010. The upper member of said U-lock 1015 has an integrally connected, inwardly facing substantially perpendicular L member 1030 positioned sufficiently before the end of said upper member 1015 so as to provide for an upper extension member 1035 facing the gap of the exterior U-lock 1010. Further extending from the end of said upper extension member 1035 is a second L member 1040 with the base also facing the gap 1050 of the exterior U-lock. The lower member of said U-lock has an integrally connected, inwardly facing substantially perpendicular L member 1045 positioned sufficiently before the end of said lower member 1020 so as to provide for a lower extension member 1055 facing the gap 1050 of the exterior U-lock 1010. Further extending from the end of said lower extension member 1055 is a second L member with the base also facing the interior gap 1050 of the exterior U-lock 1010. Further, to provide for connection of the male section of the U-lock mechanism with the blades of the shutter system, a male end of hinge 810 is integrally connected to said male U-lock shown as 1060. As with the female section, the male section includes a shutter-open-securing device 1065 which is located at the corner angle formed by the male end of hinge 810 and the upper member 1015 of exterior U-lock 1010. This is also shown connected to a blade in FIG. 17, 1730. Said shutter-open-securing device 1065 comprises a formed greater than 180 degree cylindrical member wherein is placed a screw or similar securing structure, whereon a plastic spacer is placed. Again, as clearly shown in FIG. 17, said plastic spacer 1720 is inserted into a clip member 1725, thus securing the shutter blades when in the open position.

Figure 15:
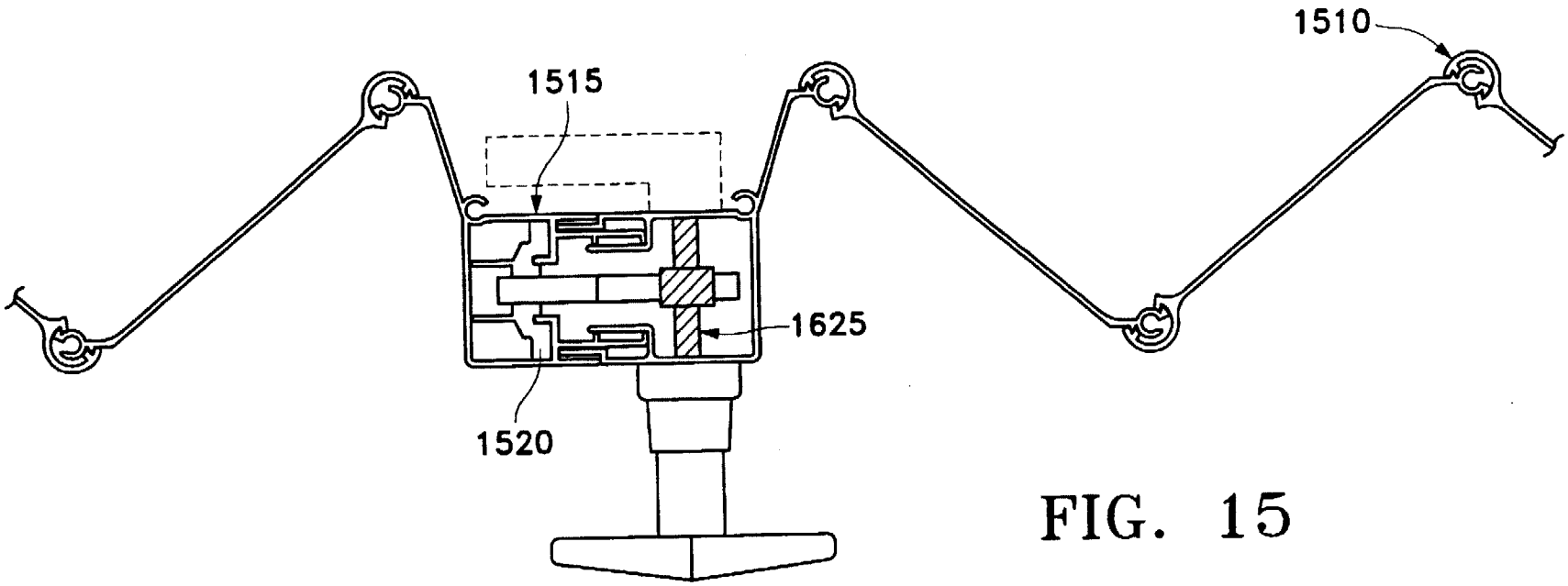
FIG. 15 is a plan view of the of locking action of individual blades and the shutter mating system of the present invention.

All L-shaped members are sized so as to snugly fit in each corresponding female U-lock. When inserted as shown in FIG. 15, 1515, the dual sided triple U-lock provides great resistance to impact wind forces.

Figure 13:
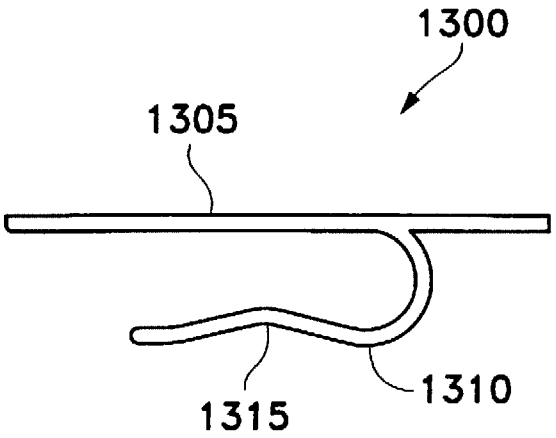
FIG. 13 depicts the securing clip member, which is secured to the header and sill, used to secure the blades when in the open or stacked position.

FIG. 13, 1300 depicts a clip member utilized in the preferred embodiment of the present invention. A base portion 1305 to the clip member connects directly to the header 15 with a fastening means such as rivets or tek screws. An integrally connected receptor portion 1310 protrudes from said base portion and forms a bottleneck portion 1315 wherein said bottleneck is sized to be be slightly smaller than said plastic spacer so as to lock said spacer in place when the shutter subsystems are in the open position.

Figure 11:
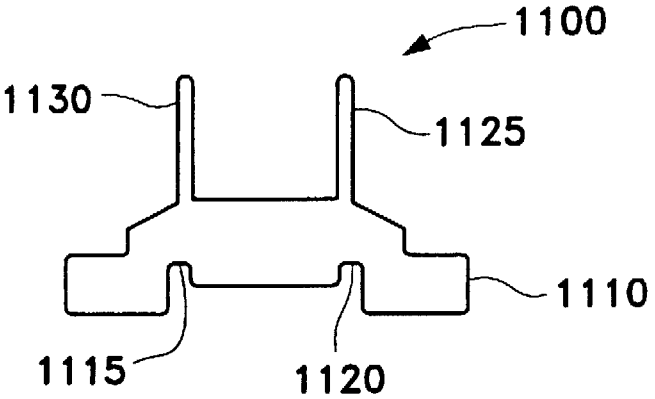
FIG. 11 illustrates the latch receiving member of the shutter mating system of the present invention.
Figure 12:
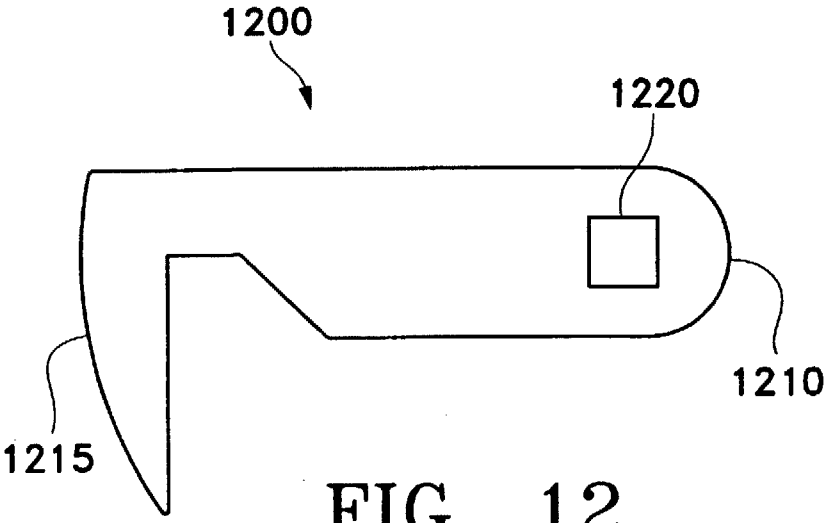
FIG. 12 depicts the latch member of the shutter mating system of the present invention.

Inserted into the female end of the gate locking system, FIG. 9, immediately adjacent said interior facing U-lock 940 is a latch receiving member shown expanded in FIG. 11 as 1100. Said clip member 1100 is further depicted in its integrated state in FIG. 15, 1520 and FIG. 16, 1615. Latch receiving member 1100 comprises a rigid base member 1110 with two notches spaced therein 1115 and 1120, and facing the U-locking mechanism such that the notches 1115 and 1120 correspond to the distance between the two L-shaped members of the interior facing U-lock 940, wherein said L-shaped members 940 fit snugly into said notches 1115 and 1120 thereby providing further structural support. Further, integrally connected to said base member on the opposite side of said notches 1115 and 1120 are substantially parallel guide prongs 1125 and 1130. These guide prongs form a gap therein to allow for a latching mechanism, FIG. 12, 1200 to fall therebetween. The latching mechanism 1200 comprises connecting member 1210 integrally connected to a hooking member 1215. Said hooking member 1215 in the latched position fits snugly over said base member 1110 of said latch receiving member 1100 and between said guide prongs 1125 and 1120, thus providing very strong resistance to transverse forces tending to break a connection between two adjacent shutter systems.

Figure 16:
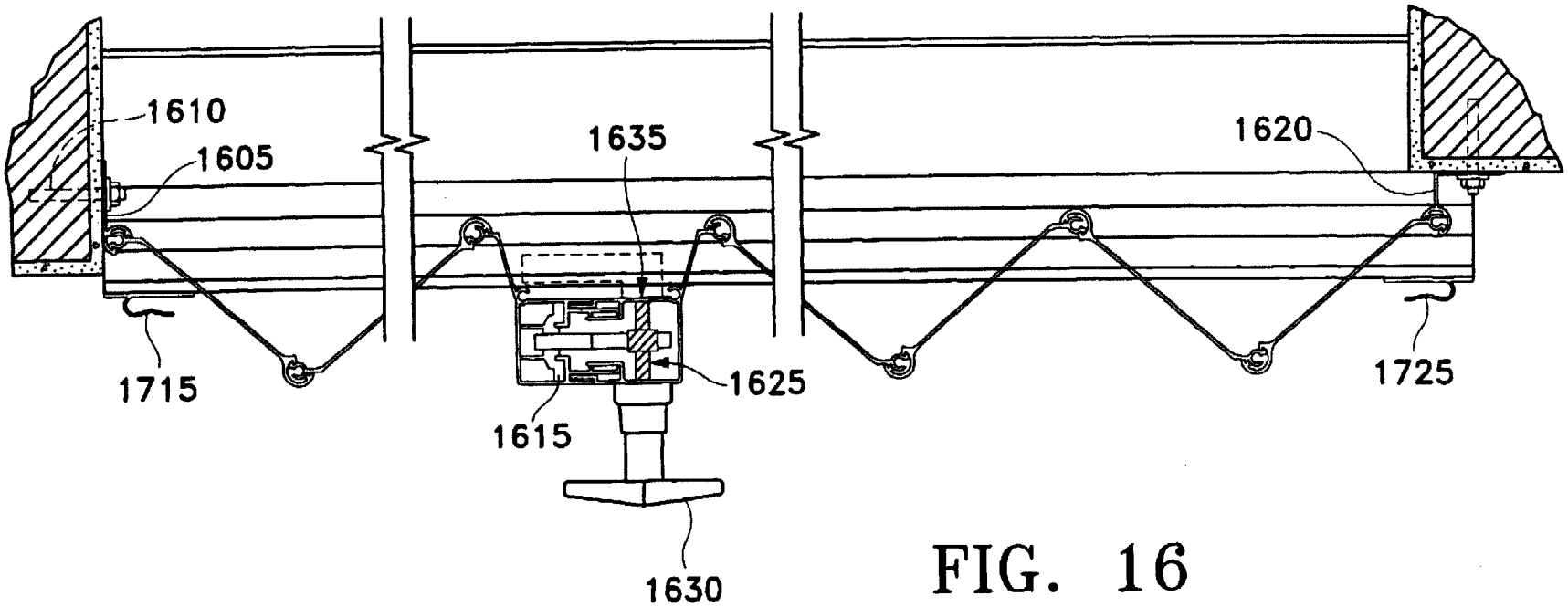
FIG. 16 is an is a plan view of the locking action of individual blades and the shutter mating system of the present invention as well as 180° degree and 9° degree wall connections and locking handle.

An aft opening 1220 in said connecting member 1210 allows for a handle protrusion, FIG. 16, 1625, to fit therethrough. Said handle protrusion 1625 is rigidly and integrally connected to a handle member 1630 such that when a user rotates said handle member 1630 it cause a rotational force to be applied to said latching mechanism 1200 to remove the hooking member 1215 from its snug position over said base member 1110 of said latch receiving member 1100 thereby allowing for separation of separate shutter subsystems.

What is claimed is:

1. A shutter accordion system, formed from a plurality of sub-accordion systems via a shutter mating assembly, comprising:

an elongated header having a vertical centerline wherein is disposed two longitudinally running trolley wheel seats extending the length of said header, one on each side of said header's vertical centerline with a corresponding v-shaped protrusion extending from the side of said header opposite said trolley wheel seat toward the interior of said header;

a two-wheeled trolley mechanism wherein wheels are situated on said trolley wheel seats such that movement in either direction along said header is possible;

a continuously extruded, substantially rectangular accordion shutter blade rotatably attached to said two-wheeled trolley mechanism with one vertical side of said blade consisting of a male end and the opposite vertical side of said blade consisting of a female end such that said male end of adjacent blades fit into said female end of said shutter blade therein forming a rotating connecting hinge with every other hinge containing a protruding guide member therethrough;

a continuous extruded sill member forming a u-shaped canal connectable to a horizontal or vertical surface, wherein is inserted said protruding guide member thus providing lateral support for said shutter blade; and a shutter subsystem connecting means for connecting adjacent shutter subsystems without the requirement of locking holes wherein said shutter subsystem connecting means comprises;

a female section with an exterior U-lock that has an upper member, a lower member and a vertical member all integrally and substantially perpendicularly connected to form the U-shape of said exterior U-Lock;

an integrally connected, inwardly facing substantially perpendicular L member positioned before the end of said upper member of said exterior U-Lock so as to provide for a female upper extension member;

an integrally connected, inwardly facing substantially perpendicular L member positioned before the end of said lower member of said exterior U-Lock so as to provide for a female lower extension member wherein in combination with said female upper extension member an outwardly facing U-Lock is formed and such that said L members are positioned opposite each other so that the base of said L members form an inwardly facing, female interior U-lock themselves;

an integrally connected substantially perpendicular member offset from said female upper extension member located on said upper L member thereby forming the upper portion of an interior, outwardly facing U-lock;

an integrally connected substantially perpendicular member offset from said female lower extension member located on said lower L-Serial member thereby forming the lower portion of an interior, outwardly facing U-lock;

a male section with an exterior U-lock which is smaller than said female section so as to fit snugly into said female exterior U-lock and has a male upper member, male lower member and male vertical member all integrally and substantially perpendicularly connected to form the U-shape of said male exterior U-lock, wherein said male upper member of male exterior U-lock of said male section has an integrally connected, inwardly facing substantially perpendicular L member positioned before the end of said male upper member so as to provide for a male upper extension member facing the gap of said exterior U-lock of said male section;

a second L member extending from the end of said male upper extension member and facing the gap of said exterior U-lock of said male section;

an integrally connected, inwardly facing substantially perpendicular L member positioned before the end of said male lower member so as to provide for a male lower extension member facing the gap of the exterior U-lock of said male section;

a second L member extending from the end of said male lower extension member and facing the gap of said exterior U-lock of said male section; and a connecting means for connecting said male and said female connecting sections with their respective shutter blade subsystems.

2. A shutter system according to claim 1, wherein said connecting means for connecting said male and said female connecting sections with their respective shutter blade subsystems, comprises an integrally connected shutter blade having opposing vertical sides with one vertical side of said shutter blade integrally connected to said male and female connecting sections and said opposing vertical side opposite of said male and said female connecting sections of said shutter blade containing a male connection to said rotating connecting hinge for connection with the female connecting hinge of an adjacent shutter blade.

3. A shutter accordion system according to claim 2, wherein the interior of said female section of said exterior U-lock contains therein a rigidly and integrally attached hook receiving member.

4. A shutter accordion system according to claim 3 wherein said hook receiving member has a rigid base member with two notches spaced therein that face said interior facing U-lock such that said notches correspond to the distance between said L-shaped members of said interior facing U-lock wherein said L-shaped members fit snugly into said notches thereby providing further structural support.

5. A shutter accordion system according to claim 4 wherein a locking mechanism secures said male end of said shutter mating system into said female end of shutter mating system.

6. A shutter accordion system according to claim 5 wherein said locking mechanism comprises:

a connecting member integrally connected to a hooking member wherein said hooking member fits snugly over said base member of said hook receiving member and wherein an aft opening in said connecting member allows for a handle protrusion to fit therethrough, with said handle protrusion rigidly and integrally connected to a handle member such that when a user rotates said handle member it cause a rotational force to be applied to said connecting member and thereby to said hooking member to remove said hooking member from its snug position over said base member of said hook receiving member thereby allowing for separation of separate shutter subsystems.

7. A shutter accordion system according to claim 6 further comprising on said male upper member and said female upper member a shutter-open-securing device formed of greater than 180° degree cylindrical member wherein is placed a screw or similar securing structure, whereon a plastic spacer is placed.

8. A shutter accordion system according to claim 7 wherein said plastic spacer on said male and said female sections fit snugly into a clip member connected directly to said header and said sill with a fastening means.

9. A shutter accordion system according to claim 8 wherein said clip member comprises an integrally connected receptor portion protruding from a base portion and forming a bottleneck portion wherein said bottleneck is sized to be slightly smaller than said spacer so as to lock said spacer in place when the shutter subsystems are in the open position.

10. A connecting system for joining shutter subsystems, and locking shutter subsystems in the open position comprising:

a female section to be attached to the end blade of one of a plurality of shutter subsystems comprising;

an exterior U-lock that has an upper member, a lower member and a vertical member all integrally and substantially perpendicularly connected to form the U-shape of said exterior U-Lock;

an integrally connected, inwardly facing substantially perpendicular L member positioned before the end of said upper member of said exterior U-Lock so as to provide for a female upper extension member;

an integrally connected, inwardly facing substantially perpendicular L member positioned before the end of said lower member of said exterior U-Lock so as to provide for a female lower extension member wherein in combination with female upper extension member an outwardly facing U-Lock is formed and such that said L members are positioned opposite each other so that the base of said L members form an inwardly facing, female interior U-lock themselves;

an integrally connected substantially perpendicular member offset from said extension member located on said upper L member thereby forming the upper portion of an interior, outwardly facing U-lock with a plurality of protrusions located thereon to provide a greater surface area and therefore greater support;

an integrally connected substantially perpendicular member offset from said lower extension member located on said lower L-member thereby forming the lower portion of an interior, outwardly facing U-lock with a plurality of protrusions located thereon to provide a greater surface area and therefore greater support;

a male section with an exterior U-lock which is smaller than said female end so as to fit snugly into said female exterior U-lock comprising;

a male upper member, male lower member and male vertical member all integrally and substantially perpendicularly connected to form the U-shape of male exterior U-lock, wherein, said male upper member of said male exterior U-lock of said male section has an integrally connected, inwardly facing substantially perpendicular L member positioned before the end of said male upper member so as to provide for a male upper extension member facing the gap of said exterior U-lock of said male section;

a second L member extending from the end of said male upper extension member and facing the gap of said exterior U-lock of said male section;

an integrally connected, inwardly facing substantially perpendicular L member positioned before the end of said male lower member so as to provide for a male lower extension member facing the gap of the exterior U-lock of said male section; and a second L member extending from the end of said male lower extension member and facing the gap of said exterior U-lock of said male section.

11. A connecting system for joining shutter subsystems of claim 10, wherein the interior of said female section of said exterior U- lock contains therein a rigidly and integrally attached hook receiving member.

12. A connecting system for joining shutter subsystems of claim 11, wherein said hook receiving member has a rigid base member with two notches spaced therein that face said interior facing U-lock such that said notches correspond to the distance between said L-shaped members of the interior facing U-lock wherein said L-shaped members fit snugly into said notches thereby providing further structural support.

13. A connecting system for joining shutter subsystems of claim 12, wherein a locking mechanism is secured to said male end of said shutter mating system into said female end of shutter mating system.

14. A connecting system for joining shutter subsystems of claim 13, wherein said locking mechanism comprises:

a connecting member integrally connected to a hooking member wherein said hooking member fits snugly over said base member of said hook receiving member and wherein an aft opening in said connecting member allows for a handle protrusion to fit therethrough, with said handle protrusion rigidly and integrally connected to a handle member such that when a user rotates said handle member it cause a rotational force to be applied to said connecting member and thereby to said hooking member to remove said hooking member from its snug position over said base member of said hook receiving member thereby allowing for separation of separate shutter subsystems.

* * * * *